United States Patent [19]

Ogren

[11] 4,014,196

[45] Mar. 29, 1977

[54] STRAIGHTENING APPARATUS

[76] Inventor: Axel E. Ogren, 855 S. 12th Ave., La Grange, Ill. 60525

[22] Filed: Apr. 6, 1976

[21] Appl. No.: 674,120

[52] U.S. Cl. ..... 72/316; 72/316; 72/453.01; 72/457

[51] Int. Cl.[2] ..... B21D 3/16

[58] Field of Search ..... 72/316, 293, 295, 305, 72/388, 380, 458, 457, 453.01, 453.18, 32

[56] References Cited

UNITED STATES PATENTS

| | | | |
|---|---|---|---|
| 347,588 | 8/1886 | George | 72/458 |
| 557,083 | 2/1897 | Tallmage | 72/458 |
| 3,965,714 | 6/1976 | Beard | 72/457 |

*Primary Examiner*—C.W. Lanham
*Assistant Examiner*—Gene P. Crosby
*Attorney, Agent, or Firm*—Hill, Gross, Simpson, Van Santen, Steadman, Chiara & Simpson

[57] ABSTRACT

An apparatus for bending components into exact desired shapes, particularly for straightening bent bolts, crank shafts and the like metal components or work pieces, has an upright frame carrying replaceable fixtures sized and shaped for securing one end of a work piece and tiltably suspending an elongated socket member for receiving the other end of the work piece. An upright straightening arm or lever is fulcrumed on the frame through a ball and socket joint and linked to the socket member for tilting the member in a direction controlled by the lever to thereby bend the work piece back into the desired alignment. A high mechanical advantage ratio is obtained through a long lever arm on one side of the fulcrum, a short lever arm on the opposite side of the fulcrum and the length of the suspended socket member propelled at one end by the short lever arm and receiving the work piece at the opposite end. In a preferred embodiment, the lever and elongated socket member are mounted upright on the frame, are connected by a sliding pivot linkage through spherical-type bearings and the lever has an operating handle on its top end. A power assist for driving the top end of the lever may include a hydraulic or pneumatic jack mounted transversely on top of the lever and urging a piston rod carried roller or bumper against a surrounding frame carried ring with guiding handles directing the roller or bumper in the ring to exert a tilting force to the lever in the desired direction.

15 Claims, 14 Drawing Figures

Fig. 5
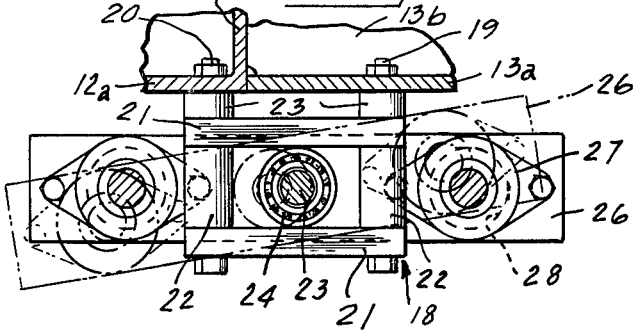
Fig. 6
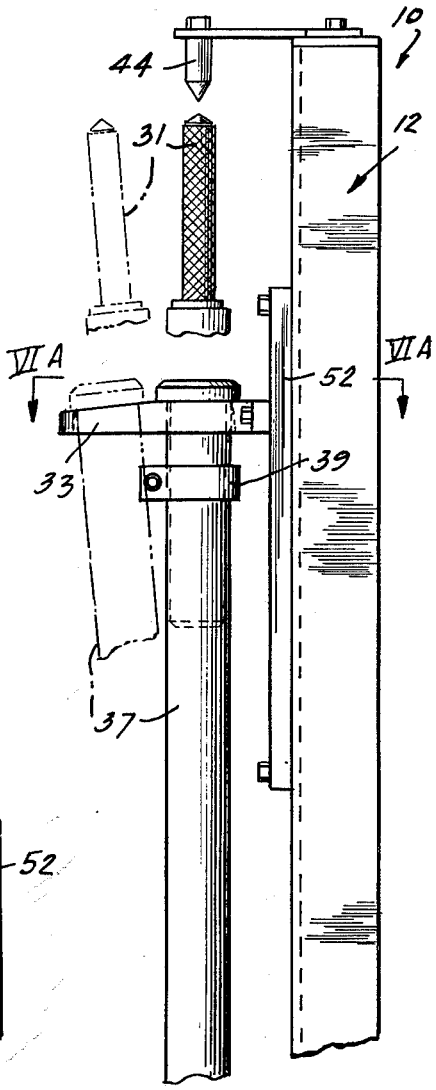
Fig. 7
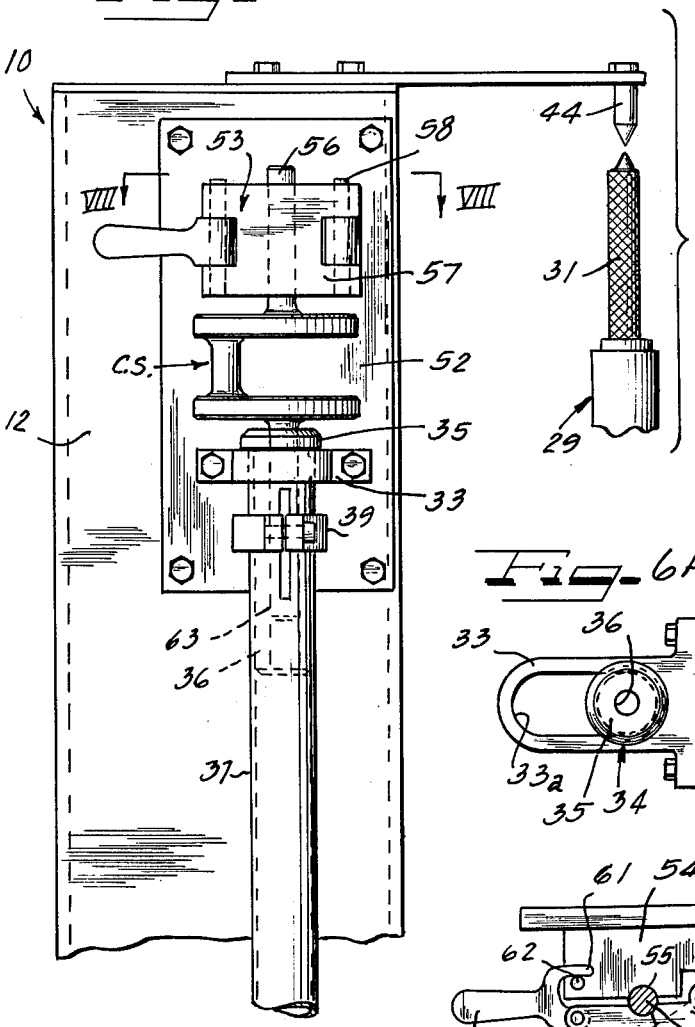
Fig. 6A
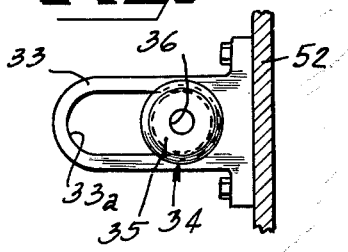
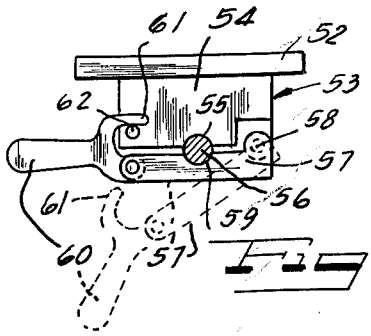
Fig. 8

Fig. 9
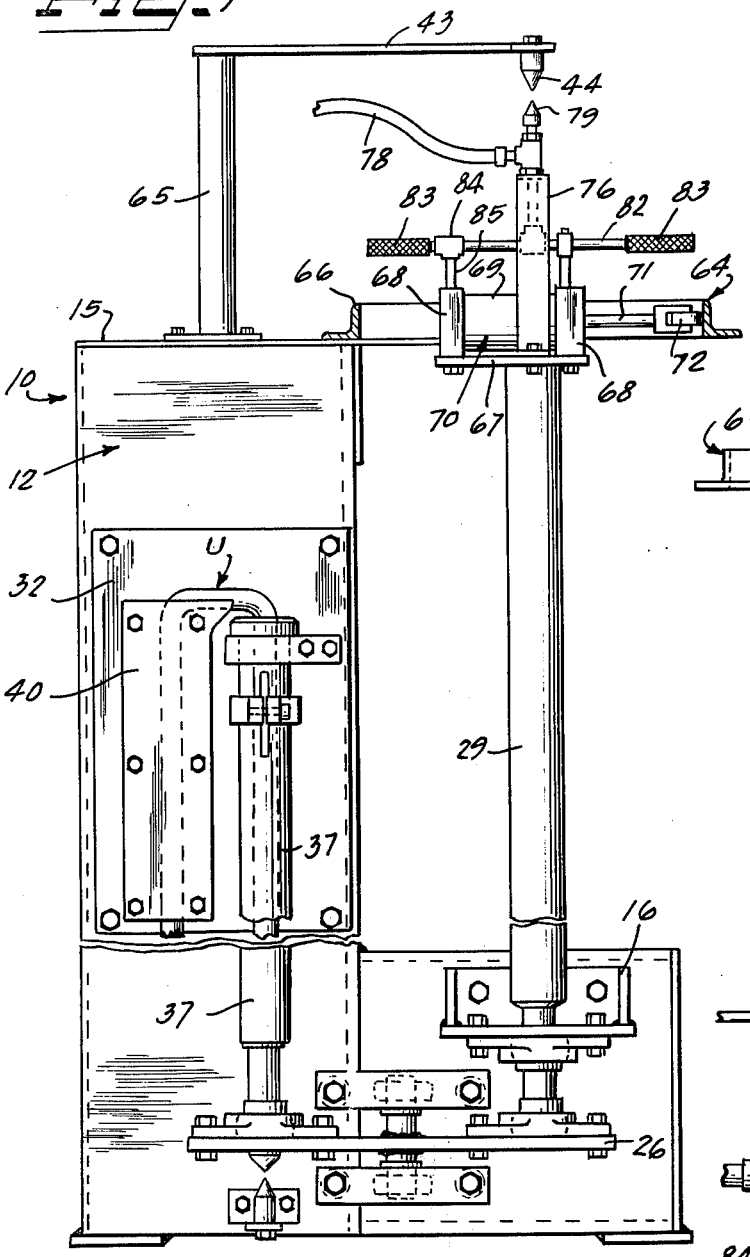
Fig. 10
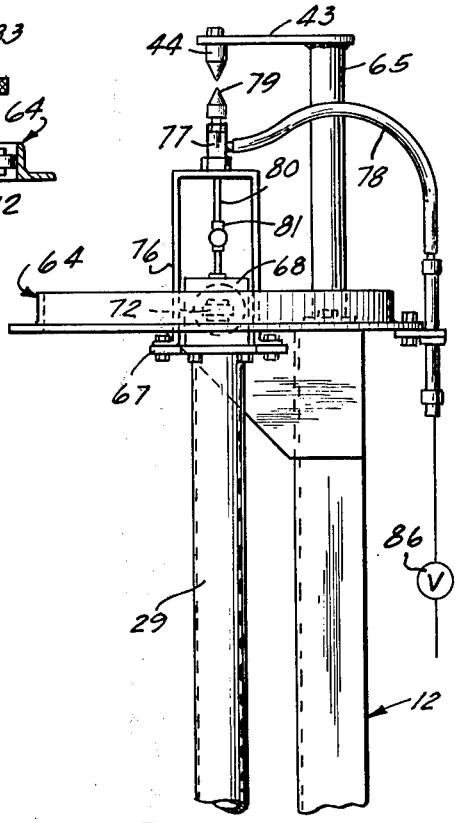
Fig. 12
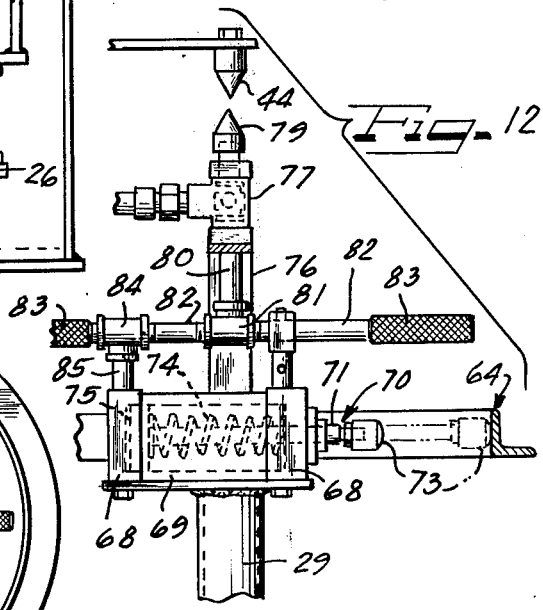
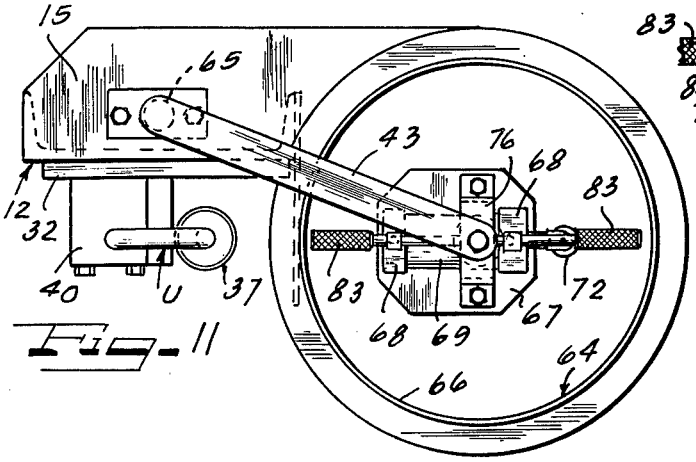
Fig. 11

STRAIGHTENING APPARATUS

FIELD OF THE INVENTION

This invention relates to the art of straightening or aligning bent work pieces such as metal crank shafts, bolts, particularly U-bolts and the like components having opposite end portions. The invention is particularly related to an upright bench-mounted tool which will easily and quickly bring the opposite ends of bendable components into the desired alignment.

BRIEF SUMMARY OF THE INVENTION

According to this invention, an upright frame tiltably suspends the top end of an elongated socket tube alongside an upright lever or straightening arm. A ball and socket joint mounted near the bottom of the frame supports the lever providing a lever of the first class with a long lever arm above the fulcrum and a short lever arm below the fulcrum. A link is pivotally mounted at its midpoint on the frame and has spherical bearings mounted at its opposite ends receiving the bottom ends of the lever and the tube. The pivot mounting for the link is also slidable relative to the frame. The upper end of the socket tube receives a bushing sized and shaped to snugly receive one end portion of a component to be straightened. A fixture mounted on the frame adjacent the upper end of the tube receives the other end portion of the component. The fixture and bushing the socket tube are removable from the frame and replaced with different sized and shaped fixtures and bushings. The top end of the long lever arm has a handle that is manipulated to cause the lever to tilt the tube and bend the portion of the component in the tube relative to the portion locked in the fixture. An indicator carried by the frame overlies the handle and when the handle and indicator are aligned, the straightening of the component has been completed.

A power assist may be provided for manipulating the long lever arm. The power assist includes a pneumatic or hydraulic jack mounted transversely on the upper end of the long lever arm and propelling a roller or bumper on the end of its piston rod against the surrounding ring carried by the frame. Handles are provided to rotate the lever and jack to present the roller or bumper to the ring at a position where the feeding of actuating fluid into the jack will tilt the lever into alignment with the indicator thereby straightening the component.

Actuating fluid is introduced into and relieved from the hydraulic jack by a valve which can be foot operated and the piston rod of the jack is preferably retracted into the jack cylinder by a spring so that the roller or bumper only thrusts against the ring when the valve is depressed to feed the fluid into the jack cylinder.

A feature of the invention is a provision of a straightening arm or lever with a ball and socket fulcrum positioned to provide a long lever arm advantage for exerting a bending force.

Another feature of the invention is to provide a straightening machine with an elongated socket tube suspended from the top end thereof and receiving one end of a work piece to be straightened and having a bottom end tilted by a lever with a free end that is manipulated to swing the lower end of the tube into position for straightening the work piece.

Another feature of the invention is to provide an inexpensive compact bench-type tool for straightening bendable work pieces.

It is then an object of this invention to provide a straightening apparatus having a high lever advantage for bending components.

Another object of the invention is to provide a bending machine with a fixture for receiving one end of a component, a swingable tube for receiving another end of a component, and a lever of the first class swinging the free end of the tube to bend the portion received therein relative to the portion received in the fixture.

Another object of the invention is to provide a straightening apparatus with an upright frame mounting a lever of the first class through a ball and socket joint near the bottom thereof, suspending an upright bending tube at the top end thereof and connecting the bottoms of the lever and tube through a pivot linkage having tiltable bearing connection with the lever and tube and a slide mounting for the pivot.

Other and further objects of this invention will become apparent to those skilled in this art from the following detailed description of the annexed sheets of drawings which, by way of preferred examples only, illustrate two embodiments of the invention.

BRIEF DESCRIPTION OF THE DRAWINGS

FIG. 2-A is a vertical cross-sectional view along the line IIA—IIA of FIG. 1.

FIG. 5 is a horizontal cross-sectional view taken along the line V—V of FIG. 1.

FIG. 6 is a fragmentary elevational view of the opposite side of the apparatus of FIG. 2.

FIG. 6-A is a horizontal cross-sectional view along the line VIA—VIA of FIG. 6.

FIG. 7 is a fragmentary front elevational view of the apparatus of FIG. 1 equipped with a different fixture for straightening a crank-shaft component.

FIG. 8 is a horizontal cross-sectional view along the line VIII—VIII of FIG. 7.

FIG. 9 is a front elevational view of an apparatus according to this invention equipped with a power assist.

FIG. 10 is a side elevational view of the apparatus of FIG. 9.

FIG. 11 is a top plan view of the apparatus of FIG. 9.

FIG. 12 is a fragmentary front elevational view of the power assist mechanism showing additional details and a modification.

DETAILED DESCRIPTION OF THE PREFERRED EMBODIMENTS

Figures 1, 2, 2A, 3, 4:
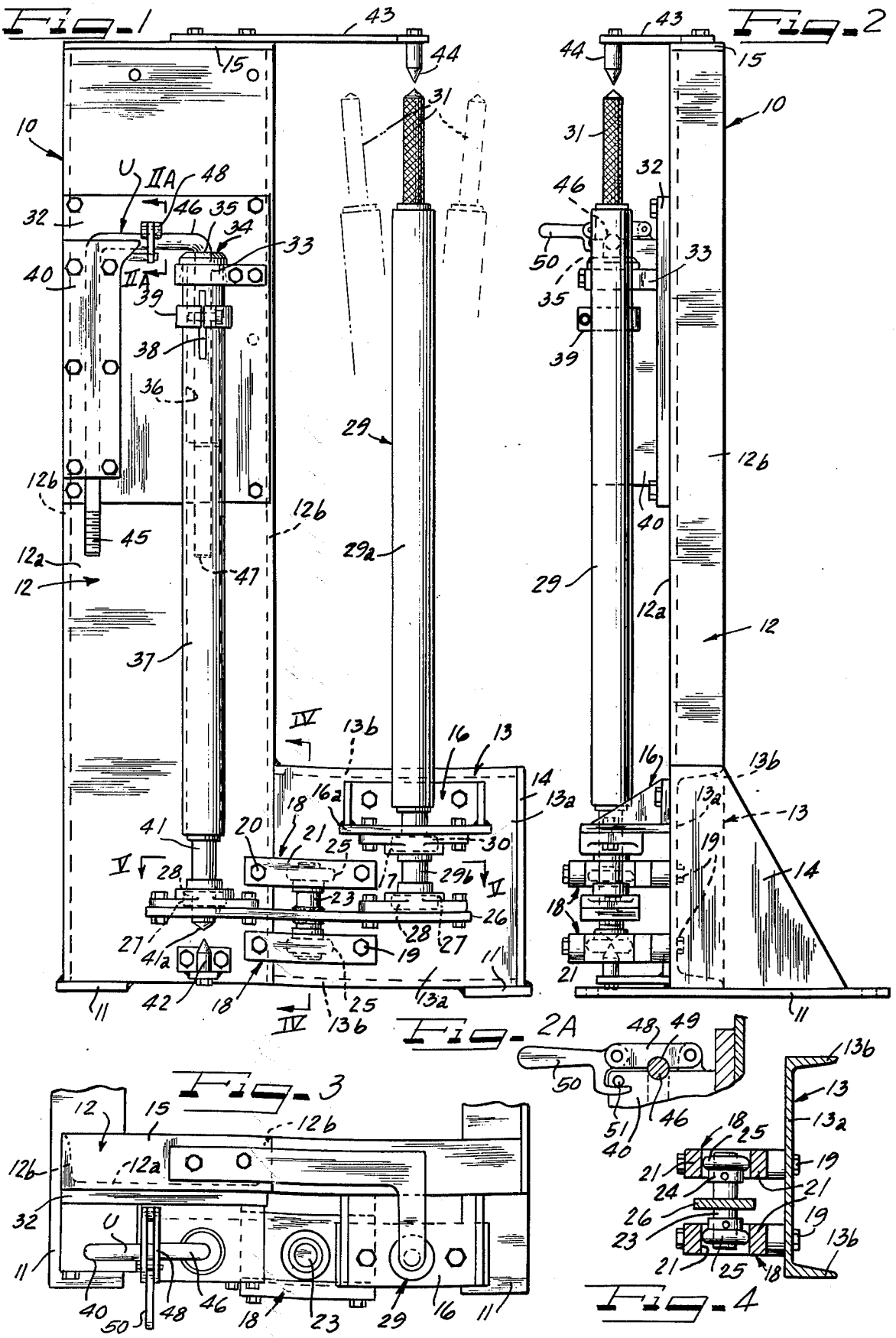
FIG. 1 is a front elevational view of a straightening apparatus according to this invention.
FIG. 2 is a side elevational view of the apparatus of FIG. 1.
FIG. 3 is a fragmentary top-plan view of the apparatus of FIGS. 1 and 2.
FIG. 4 is a vertical cross-sectional view taken along the line IV—IV of FIG. 1.

The apparatus 10 FIGS. 1 – 3 has a framework composed of spaced parallel feet 11, 11 adapted to be bolted on a bench or base frame (not shown), an upright wide web channel 12, a similar channel 13 extending horizontally from the bottom of the channel 12, a gusset plate 14 at the end of the channel 13 and a top plate 15 overlying the channel 12. The channel 12 has a wide web **12*a*** providing a flat front wall and rearwardly directed end flanges 12*b*. The horizontal channel 13 has a wide web 13*a* and rearwardly directed top and bottom flanges 13*b*. The channels 12 and 13 may be of the same metal channel beam construction with the inner end of the channel 13 welded to the inner end flange 12*b* of the channel 12 and with the gusset plate 14 welded to the outer end of the horizontal channel 13. The bottom of the channel 12 is welded to one foot 11 while the bottom of the channel 13 and the bottom of the gusset plate 14 are welded to the other foot 11. An L-shaped frame is thus provided with wide webs or faces 12*a* and 13*a*.

A bracket 16 is bolted to the front face of the web 13*a* near the top of the channel 13 providing an apertured forwardly projecting horizontal flange 16*a* from which is suspended a ball socket 17.

Below the bracket 16 and laterally offset therefrom are mounted a pair of spaced superimposed straps, 18, 18. As shown in FIGS. 4 and 5, each strap 18 includes a bolt 19 projecting forwardly from the web 13*a* of the channel 13 and a bolt 20 projecting forwardly from the web 12*a* of the channel frame 12. Each bolt 19 and 20 supports spaced parallel bars 21 separated by spacer 22 and also spaced from the webs 12*a* and 13*a* by spacer 23 on the bolts 19 and 20.

A pivot pin 23 spans the space between the straps 18, 18 and has ball bearings 24 on its ends with spherical outer race rings 25 riding on the bars 21 in slidable and tiltable relation. A link plate 26 is secured at its midpoint to the pin 23 and extends through the space between the straps 18, 18 to project laterally beyond the straps. The ends of the link plate 26 carry ball sockets 27 in which are mounted the outer race rings of spherical bearings 28.

A straightening arm or actuating lever 29 is mounted upright on the front of the frame and has a ball member 30 tiltably mounted in the socket 17 together with a bottom end mounted in the bearing 28 underlying the bracket 16. The lever 29 is thus fulcrumed on the frame near the bottom end thereof and has a long upright lever arm portion 29*a* above the fulcrum and a short lever arm 29*b* below the fulcrum with its end projecting into the underlying bearing 28 carried by the link plate 26. The top end of the lever 29 has a handle 31 which is to be manually grasped and manipulated for tilting the lever 29 in all directions thereby either rotating the link 27 about its pivot pin 23 or tilting the link through the sliding of the outer race rings 25 of the bearings 24 on the bars 21.

A fixture plate 32 is bolted on the front face of the web 12*a* near the upper end of the channel 12 and a bracket 33 is bolted on this plate 32 projecting forwardly therefrom to provide a slot which can be circular for some workpieces or, as shown in FIG. 6*a*, can be a forwardly elongated slot 33*a*. A tubular bushing 34 is suspended from this bracket and has a head 35 overlying the bracket together with elongated tubular portion 36 depending the head and surrounded by an elongated tube 37. The suspension arrangement is such that the elongated tube 37 can slide toward and away from the plate 32 in tiltable relationship with the bracket 33. The tube 37 preferably has a slot 38 near the top thereof and a clamp 39 surrounds the slotted portion to clamp the tube to the tubular portion 36 of the bushing 34.

The plate 32 also carries a fixture 40 providing a socket for receiving one end portion of a component to be straightened.

The bottom end of the tube 37 has a pin 41 extending therefrom fitting in the underlying bearing 28. The bottom end of this pin 41 is pointed at 41*a* and an opposed pointer 42 is mounted on the web 12*a* under this pointed end 41 to act as an indicator for aligning the point 41*a* with the pointer 42.

The top plate 15 of the channel frame 12 mounts an L-shaped arm 43 from which depends a pointer 44 over the handle 31 of the lever 29 to indicate an upright vertical position for the lever.

As illustrated in FIGS. 1 – 3, a U-bolt "U" is mounted in the apparatus forming the component to be straightened. This U-bolt has one leg 45 extending through the fixture 40, a bight portion 46 overlying the fixture 40, and a second leg 47 snugly fitting in the socket tube 36. The socket tube and its depending elongated tube 37 can slide and tilt in the mounting bracket 33 to receive this leg 47 even when it is substantially bent from parallel relationship with the leg 45. The tube 37 when tilted will tilt the pin 41 at its lower end causing a tilting or pivoting of the link 26 thereby rocking the lever 29 to an inclined position such as is shown in dotted lines in FIG. 1. Then, when the handle 31 of the lever 29 is forced into alignment with the indicator 44, the elongated tube 37 and its inserted bushing 34 will be forced into parallel relationship with the lever 29 and the U-bolt U will be bent to its desired shape. The pivot pin 23, of course, supports the link 26 for free rotation, and since the bearings 25 mounting the pivot are also slidable between their mounting bars 21, the link 26 can also move laterally and tilt.

To prevent the bight portion 46 from buckling during the bending of the leg 47 relative to the leg 45, an overlying link 48 can be pivotally mounted on the plate 32 with a notch 49 (FIG. 2-A) receiving the bight portion 46 and with a pivoted locking handle 50 on the free end of the link 48 having a hooked portion engaging a pin 51 to secure the bight portion 46 in the notch 49 of the link.

As shown in FIGS. 7 and 8, the fixture plate 32 may be replaced with a plate 52 having a fixture 53 for receiving one end of a crank shaft component C.S. This fixture 53 has a base 54 with a vertical groove 55 receiving the top pin end 56 of the crank shaft C.S. A cover 57 is pivoted on the base by a pin 58 and has a cooperating groove 59 to register with the groove 55. The cover has a handle 60 pivoted on the free end thereof with a hook portion 61 adapted to overlie and lockingly engage a pin 62 on the base 54. The pin end 56 of the crank shaft C.S. is thus clamped in this fixture 53 above the bushing 36 of the socket tube 37 with the lower pin end 63 of the crank shaft C.S. snugly fitted in this bushing 36. Any misalignment of the ends 56 and 63 will tilt or slide the tube 37 thereby swinging the lever 29 and misaligning the handle 31 from the indicator 44. The handle is then manipulated to bring it into registration with the indicator 44 thereby straightening the crank shaft C.S.

It will be understood that the socket bushing 36 is replaceable in the tube 37 to provide different size holes for snugly engaging one end portion of the component to be straightened.

As shown in FIGS. 9 – 12, a power assist assembly 64 is provided to drive the straightening arm or lever 29 and for this purpose the arm 43 carrying the indicator 44 is raised to a higher level and is mounted on a post 65 carried by the top plate 15 of the frame so as to make room for the power assist mechanism.

The power assist mechanism 64 includes a metal ring 66 mounted on the top plate 15 of the frame 12 and extending laterally therefrom to embrace the lever 29. The handle 31 of the lever 29 is replaced with a flange 67 and end heads 68 of the cylinder 69 of a hydraulic or pneumatic jack 70 are bolted on this flange 67. The jack 70 has a piston rod 71 extending through one end head 68 and carrying a roller 72 on the end thereof to ride on the inner circumference of the ring 64. As shown in FIG. 12, this roller can be replaced with a plastic or rubber bumper 73 having a rounded end riding on the ring 64. The piston rod 71 is retracted into the cylinder 69 by a spring 74 and is propelled from the cylinder by a piston head 75.

A strap 76 secured on the top of the flange 67 embraces the cylinder 69 and mounts a coupling 77 connected to a hydraulic fluid or air hose 78. A pointer 79 is mounted on the top end of this coupling 77 to be aligned with the indicator pointer 44 depending from the arm 43. The coupling 77 is also connected to an upright tube 80 to a second coupling 81 which has pipes 82 extending laterally therefrom and closed at their ends by handles 83. One pipe 82 communicates through a coupling 84 with a tube 85 communicating with the cylinder 69 through an end head 68 beyond the piston 75 thereby feeding operating fluid against the piston head forcing it against the spring 74 and ejecting the rod 71 from the opposite end head of the cylinder thereby passing either the roller 72 or the bumper 73 against the ring 64.

The handles 83 are manually manipulated to present the roller 72 or bumper 73 to an area of the surrounding ring 64 which will provide a rigid backing for tilting the lever 29 in the desired direction when fluid power is applied to the cylinder. This fluid power can be controlled by a valve 86 which may be operated by a foot pedal leaving the operator's hands free to grasp both handles 83. The arrangement is such that the handles are manipulated to present the roller or bumper against that portion of the ring 64 which will provide a rigid backing for propelling the lever 29 into upright position aligned with the indicator 44 thereby straightening the work piece component such as the illustrated U-bolt U.

Since the lever 29 has a long lever portion above the fulcrum and a short level arm portion driving the link and since the tube 37 is elongated and has its link propelled end remote from the suspended end, a very high mechanical advantage is obtained to exert bending forces on the components to be straightened. For conventional U-bolts, manual manipulation of the straightening arm or lever is sufficient to provide all the bending forces that are needed. The power assist, however, is desirable for bending heavier work pieces.

From the above descriptions, it will be understood that this invention provides a simple inexpensive and compact apparatus or tool for straightening bent work pieces.

I claim as my invention:

1. An apparatus for bending metal components into exact desired shapes which comprises a frame, a lever fulcrumed on said frame for tilting in all directions, a fixture on said frame sized for receiving one end portion of a component to be bent, a socket tube on said frame adjacent said fixture for receiving an opposite end portion of the component to be bent, means on said frame tiltably suspending said socket, and a link connecting said lever with said socket to tilt the socket relative to the fixture and thereby bend the end portion of the component in the socket relative to the end portion of the component in the fixture.

2. An apparatus for straightening bent metal components such as bolts, crank shafts and the like which comprises an upright frame, a fixture on said frame sized for receiving one end portion of a component to be bent, an elongated socket tube tiltably suspended on said frame sized for receiving the opposite end portion of the component to be bent, an upright lever fulcrumed on said frame for tilting in all directions, a link connecting said lever with said socket tube, an indicator on said frame coacting with said lever to show the direction and extent of the bent portion of the component, and said lever, link and socket tube being correlated so that when the lever is manipulated into alignment with the indicator, the component will be bent back into its straightened condition.

3. A straightening apparatus which comprises an upright frame adapted to be bolted to a bench or the like, a socket tube tiltably suspended from its upper end on said frame, a bushing fitted in the top end of the socket tube sized for receiving one end of a component to be straightened, a fixture on said frame adjacent said socket tube sized for receiving an opposite end of the component to be straightened, a ball and socket joint mounted on said frame, an upright lever fulcrum near its bottom end in said ball and socket joint having a long lever arm above the joint and a short level arm below the joint, a horizontal link pivoted at its midpoint on said frame, ball and socket joints at the ends of said link connecting the link to bottom ends of the socket tube and lever, and a mounting on said frame for the pivot of said link accommodating sliding and tilting of the pivot whereby manipulation of the long lever arm will actuate the link to tilt the socket tube and align the portion of the component in the bushing relative to the portion of the component in the fixture to thereby straighten the component.

4. The apparatus of claim 1 wherein the fulcrum connection between the lever and the frame is a ball and socket joint.

5. The apparatus of claim 1 wherein the socket tube and the lever are mounted upright on the frame.

6. The apparatus of claim 1 including a power assist mechanism for propelling the lever.

7. The apparatus of claim 6 wherein the power assist mechanism includes a ring mounted on the frame surrounding the lever, and a fluid pressure actuated jack mounted on the lever having a piston rod adapted to thrust against the ring for tilting the lever.

8. The apparatus of claim 1 wherein the lever has a handle on the free end thereof and the frame carries an indicator positioned so that when the handle is aligned with the indicator, the component in the apparatus will be straightened.

9. The apparatus of claim 2 wherein the link has a pivot pin at its midpoint and the frame mounts the pivot pin for tilting and sliding relative to the frame.

10. The apparatus of claim 2 wherein the socket tube is split, has an open top end, a tubular bushing is inserted in said top end, and a clamp surrounds the split tube locking the bushing therein.

11. The apparatus of claim 2 wherein the fixture and the socket tube are mounted on a plate removably bolted on the frame.

12. The apparatus of claim 2 including a clamp on the frame between the fixture and the socket tube overlying the work piece to prevent bending of an intermediate portion thereof.

13. The apparatus of claim 2 including a slotted hanger on the frame suspending the socket tube.

14. The apparatus of claim 3 wherein the socket tube is contractible around the bushing and the bushing has a head overlying the socket tube.

15. The apparatus of claim 13 wherein a bushing is clamped in the tube and has a head overlying the hanger.

* * * * *